US010480262B2

(12) United States Patent
Porta et al.

(10) Patent No.: US 10,480,262 B2
(45) Date of Patent: Nov. 19, 2019

(54) DOWNHOLE SLIP APPARATUS

(71) Applicant: Weatherford U.K. Limited, Leicestershire (GB)

(72) Inventors: Santiago Galvez Porta, Peterhead (GB); Stephen Reid, Leicestershire (GB); Philip CG Egleton, Newmachar (GB)

(73) Assignee: WEATHERFORD U.K. LIMITED (GB)

( * ) Notice: Subject to any disclaimer, the term of this patent is extended or adjusted under 35 U.S.C. 154(b) by 218 days.

(21) Appl. No.: 15/459,311

(22) Filed: Mar. 15, 2017

(65) Prior Publication Data

US 2017/0268301 A1 Sep. 21, 2017

(30) Foreign Application Priority Data

Mar. 15, 2016 (GB) ..... 1604389.5

(51) Int. Cl.

*E21B 33/129* (2006.01)
*E21B 19/10* (2006.01)
*E21B 33/128* (2006.01)

(52) U.S. Cl.

CPC ..... *E21B 19/10* (2013.01); *E21B 33/128* (2013.01); *E21B 33/129* (2013.01)

(58) Field of Classification Search

CPC ..... E21B 23/01; E21B 33/129; E21B 33/1293
See application file for complete search history.

(56) References Cited

U.S. PATENT DOCUMENTS 2,546,377 A * 3/1951 Turechek ..... E21B 33/1293 166/134
3,064,738 A 11/1962 Clark, Jr. et al.
3,244,233 A * 4/1966 Villalon, Jr. ..... E21B 23/06 166/123
3,702,634 A 11/1972 Anderson et al.
4,059,150 A * 11/1977 Manderscheid ..... E21B 23/06 166/120
4,497,368 A * 2/1985 Baugh ..... E21B 43/10 166/208
5,566,762 A * 10/1996 Braddick ..... E21B 7/061 166/117.6
6,769,491 B2 8/2004 Zimmerman
(Continued)

FOREIGN PATENT DOCUMENTS

GB 2296520 A 7/1996
GB 2545817 A1 6/2017
WO 2014120543 A1 8/2014

*Primary Examiner* — Kipp C Wallace
(74) *Attorney, Agent, or Firm* — Blank Rome, LLP

(57) ABSTRACT

A downhole slip apparatus that includes a radially extendable slip assembly. The radially extendable slip assembly including a primary slip arrangement and a secondary slip arrangement. The downhole slip apparatus is arranged such that during a first phase of operation the primary and secondary slip arrangements are radially extendable simultaneously from a retracted configuration towards and/or into a first extended configuration. The downhole slip apparatus is also arranged such that during a subsequent second phase of operation the secondary slip arrangement is radially extendable relative to the primary slip arrangement towards and/or into a second extended configuration.

23 Claims, 3 Drawing Sheets

(56) References Cited

U.S. PATENT DOCUMENTS

| | | | | |
|---|---|---|---|---|
| 6,827,150 | B2 | 12/2004 | Luke | |
| 2004/0216893 | A1* | 11/2004 | Hirth | E21B 23/01 166/382 |
| 2006/0278404 | A1* | 12/2006 | Fay | E21B 23/01 166/382 |
| 2009/0038808 | A1 | 2/2009 | Anderson | |
| 2010/0186947 | A1 | 7/2010 | Bishop et al. | |
| 2011/0284208 | A1 | 11/2011 | MacLeod et al. | |
| 2014/0209293 | A1* | 7/2014 | Lehr | E21B 33/128 166/134 |
| 2015/0021048 | A1* | 1/2015 | Ruffo | E21B 23/01 166/382 |
| 2015/0114620 | A1* | 4/2015 | Halfmann | E21B 33/1292 166/77.51 |
| 2015/0292283 | A1* | 10/2015 | Lemm | E21B 33/1291 166/217 |

* cited by examiner

DOWNHOLE SLIP APPARATUS

CROSS-REFERENCE TO RELATED APPLICATIONS

This application claims the benefit under 35 U.S.C. § 119(a) of UK Appl. GB1604389.5, filed 15 Mar. 2016.

FIELD

The present disclosure relates to a downhole slip apparatus, and associated method.

BACKGROUND

Many downhole operations require an anchor to be established within a wellbore, for example to secure tubing and equipment within the wellbore and to establish a reaction point for other wellbore operations, such as setting packers, bridge plugs, frac plugs or the like.

Slip systems and apparatus are known in the art for establishing downhole anchors, with many different designs of slip system in current use. Such slip systems typically include a number of slip members which are radially expanded or moved into engagement with a bore wall. Cone based slip systems are known, in which a cone is axially moved relative to one or more slips to radially expand and support the slips in engagement with a bore wall.

It is recognized that some conventional slip systems and apparatus may have limited expansion capabilities, at least not without compromising load ratings when fully expanded. Some proposals have been made in the art to permit higher expansion ratios to be achieved. For example, US 2011/0284208 discloses a telescopic slip system that includes a slip mounted within a cone, wherein the cone is radially moved by a cone expander, with the slip permitted to be radially moved relative to the cone.

U.S. Pat. No. 6,827,150 discloses a high expansion packer which includes a slip member which is moved radially outwardly over radially stacked cones.

SUMMARY

An aspect or embodiment relates to a downhole slip apparatus, comprising: a radially extendable slip assembly comprising a primary slip or slip arrangement and a secondary slip or slip arrangement; wherein during a first phase of operation the primary and secondary slips or slip arrangements are radially extendable simultaneously from a retracted configuration towards and/or into a first extended configuration, and during a subsequent second phase of operation the secondary slip or slip arrangement is radially extendable relative to the primary slip or slip arrangement towards and/or into a second extended configuration.

The slip apparatus may comprise a selective coupling or clutch arrangement. The selective coupling or clutch may be operable such that during the first phase of operation the primary and secondary slips are radially extendable simultaneously from a retracted configuration towards and/or into a first extended configuration, and during the subsequent second phase of operation the secondary slip is radially extendable relative to the primary slip towards and/or into a second extended configuration.

It will be appreciated that, in use, the downhole slips apparatus may be configured for anchoring to a wall or inner surface of a bore, well, tubular, conduit or other suitable receptacle.

The downhole slip apparatus may comprise or be configured to receive a slip actuator. In use, the slip assembly may be radially extended or extendable towards the bore or other receptacle by operation of the slip actuator.

The slip assembly may be configured such that, during the first phase of operation, the primary and secondary slips or slip arrangements are coupled, fixed, or otherwise arranged together for simultaneous, synchronized, and/or cooperative movement together.

The selective coupling or clutch arrangement may act and/or be provided between the primary and secondary slips or slip arrangements. The selective coupling or clutch arrangement may be operated or actuated between the first phase and the second phase of operation in order to switch the selective coupling or clutch arrangement from a configuration in which the primary and secondary slips or slip arrangements are coupled, fixed or otherwise arranged together into a configuration in which the primary and secondary slips or slip arrangements are radially extendable relative to each other.

The radial extension of the slip assembly may be executed until engagement with the wall or inner surface of the bore wall is achieved. Such bore wall engagement may be sufficient to secure, for example anchor, the slip apparatus within the bore or other receptacle.

The provision of first and subsequent second phases of operation may permit at least first and subsequent expansion ratios to be achieved. When in the first extended configuration, the slip apparatus may have a first maximum outer diameter. The first extended configuration may be particularly suited for anchoring the slip apparatus to smaller diameter boreholes or other receptacles. Since, during the first phase, the secondary slip or slip arrangement moves simultaneously with the primary slip or slip arrangement, a large total wall engaging surface that comprises both the primary and secondary slips or slip arrangements may be provided in the first extended configuration. When in the second extended configuration, the slips apparatus may have a second maximum outer diameter, which may be greater than the first maximum outer diameter. The second extended configuration may be achieved by extending the secondary slip or slip arrangement beyond the primary slip apparatus. The second extended configuration may be particularly suited for anchoring the slip apparatus to larger diameter boreholes or other receptacles, in which the first extended configuration is not wide enough to anchor the borehole walls.

The primary slip or slip arrangement may define a first wall engaging surface, which may be or comprise a surface of the primary slip or slip arrangement that is radially outer or outermost with respect to the slip apparatus. The secondary slip or slip arrangement may define a second wall engaging surface, which may be or comprise a surface of the secondary slip or slip arrangement that is radially outer or outermost with respect to the slip apparatus.

In the retracted configuration, the first and second wall engaging surfaces may be flush, coplanar, aligned and/or in register.

The first and second wall engaging surfaces may remain flush, coplanar, aligned and/or in register during or throughout the first phase of operation and/or in the first extended configuration. During the first phase of operation, the first and second wall engaging surfaces may contact the borehole wall at the same time. In the first extended configuration, the slip apparatus may be configured to engage with, and/or anchor to, the borehole wall or other receptacle with both first and second wall engaging surfaces, e.g. substantively simultaneously. Therefore, the slip apparatus may be used in smaller diameter boreholes or other receptacles and may do so with a full or large engaging surface, e.g. with both primary and secondary slips or slip arrangements in engagement with the borehole wall or other receptacle at the same time. This may provide a full or larger force rating than would be the case if the slip apparatus engaged the wall with the secondary slip wall engaging surface only.

During the second phase of operation, which is subsequent to the first phase of operation, and/or in the second extended configuration the secondary slip or slip arrangement may extend beyond the primary slip or slip arrangement. As such, the slip apparatus may be configured such that, when in the second extended configuration, only the second wall engaging surface may anchor to the borehole wall or other receptacle. Therefore the slip apparatus may also be used to provide an anchor point in borehole walls of larger diameter, albeit which may only use the second wall engaging surface.

The overall result may be a versatile slip or slip arrangement that can be used both in smaller diameter boreholes and in larger diameter boreholes.

The radially extendable slip assembly may comprise a plurality of primary and/or secondary slips or slip arrangements. At least one of the primary and/or secondary sips or slip arrangements may be radially extendable independently of at least one other of the primary and/or secondary slips or slip arrangements. The plurality of primary and secondary slips or slip arrangements may be distributed circumferentially around the radially extendable slip assembly. In this way, improved engagement with the bore, well, tubular, conduit or other suitable receptacle may be achievable, even if the radially extendable slip assembly is not centered in the bore, well, tubular, conduit or other suitable receptacle.

The first and second wall engaging surfaces may comprise piercing features, which may comprise spikes or points. The primary and secondary wall engaging surfaces may comprise interference features, such as plateaus.

The slip apparatus may be configured such that, if the slip apparatus is in the first extended configuration, e.g. the primary slip or slip arrangement has extended to its maximum extension, and the first and second wall engaging surfaces have not contacted the borehole wall, then the second operation phase begins, e.g. automatically begins, and only the secondary slip or slip arrangement may continue extending radially until the second wall engaging surface makes contact with, and anchors to, the borehole wall. The slip apparatus may then be set in the second extended configuration.

The selective coupling or clutch arrangement may be operable or actuated according to an operating parameter, such as a force applied to the selective coupling or clutch arrangement. The force may be or comprise a force directly or indirectly applied to the selective coupling or clutch, e.g. in a longitudinal direction thereof, which may be or comprise or result from a force applied using the slip actuator. The operating parameter may comprise a position, extension amount, or configuration of at least the primary slip or slip arrangement.

The selective coupling or clutch arrangement may be operable or switchable between a configuration in which the primary and secondary slips or slip arrangements are radially extendable simultaneously, synchronously and/or cooperatively together and a configuration in which the secondary slip or slip arrangement is radially extendable relative to the primary slip or slip arrangement. The selective coupling or clutch arrangement may be configured such that the primary and secondary slips or slip arrangements are selectively coupled, fixed or otherwise held together, e.g. for simultaneous, synchronized and/or cooperative movement together, when the operating parameter is in a first range, e.g. lower than a threshold, which may be during the first phase.

The selective coupling or clutch arrangement may be configured to permit the primary and secondary slips or slip arrangements to be radially extended or extendable relative to each other, e.g. when the operating parameter is in a second range, e.g. greater than the threshold. The selective coupling or clutch arrangement may be configured to permit the primary and secondary slips or slip arrangements to be radially extended or extendable relative to each other during the subsequent second phase.

The selective coupling or clutch arrangement may be configured so as to require a greater force for the second phase of operation than for the first phase of operation. This may be especially useful in a preferred embodiment when a single slip actuator causes movement of a primary slip or slip arrangement displacement mechanism to simultaneously move both the primary slip or slip arrangement and the secondary slip or slip arrangement mounted on the primary slip or slip arrangement, during a first, e.g. low force, phase of operation and the secondary slip or slip arrangement mechanism is only to be activated in a second, e.g. high force, phase of operation after the first phase of operation has ended, i.e. sequentially.

The primary slip arrangement may comprise at least first and second parts. The selective coupling or clutch arrangement may be located and/or coupled between the first and second parts of the primary slip or slip arrangement displacement mechanism. The selective coupling or clutch arrangement may be operable or switchable between a configuration in which the first and second parts of the primary slip or slip arrangement are locked against movement relative to each other and a configuration in which the first and second parts of the primary slip or slip arrangement are movable relative to each other. The slip assembly may be configured such that movement of the first part of the primary slip or slip arrangement relative to the second part of the primary slip or slip arrangement causes the secondary slip or slip arrangement to extend radially outwardly relative to the primary slip or slip arrangement.

The selective coupling or clutch arrangement may comprise an interference fit mechanism.

The interference fit mechanism may comprise a receiving member, e.g. a hollow receiving member, such as a tube or mandrel and an interfering member. At least part of the interfering member may be provided or receivable within the receiving member. The interfering member may comprise an engaging part, such as a ball or other partially spherical, rounded, cylindrical, or barrel shaped member. The interfering member may comprise a support for supporting the engaging part. The receiving member may comprise a cavity, such as an elongate cavity, for receiving the interfering member.

The receiving member may be coupled to the first part of the primary slip or slip arrangement. The interfering member may be coupled to the second part of the primary slip or slip arrangement.

The cavity of the receiving member may have a smaller inner diameter than the outer diameter of the engaging part, e.g. such that the engaging part engages or is fitted with an interference fit with a wall of the cavity, e.g. in at least one or more configurations of the selective coupling or clutch arrangement, which may be during the first phase of operation. This interference between the interfering member and the receiving member may be such that it permits relative movement of the interfering member and the receiving member when the force applied to the selective coupling or clutch arrangement is above the threshold. Local deformations, which may comprise elastic and/or plastic deformations, may be formed at the contact area between the engaging part and the wall of the cavity, which may allow the engaging part, and thereby the interfering member, to move relative to the receiving member.

The selective coupling or clutch may be configured such that, as the engaging part moves, the cavity wall at the back of the engaging part restores at least partially back towards its previous or undeformed position. This may prevent or inhibit the interfering member and the receiving member from making a return movement. This return movement may occur in slip apparatuses provided with a ratcheting mechanism to prevent the tool from partially retracting or stowing, which may be enough to cause the slip apparatus to loose grip. This is what is known in the art as back-lashing problems. This interference fit clutch mechanism may help reduce backlashing problems.

The clutch arrangement may comprise other clutching mechanisms such as frictional mechanisms, and/or the like.

The slip actuator may be configured and/or operable to provide or cause the first phase of operation, e.g. to simultaneously radially extend the primary and secondary slips or slip arrangements.

The slip actuator may be configured and/or operable to provide or cause the subsequent second phase of operation, e.g. to radially extend the secondary slip relative to the primary slip relative to the primary slip. In such an arrangement, a single slip actuator may cause or provide both first and second phases of operation. Therefore the slip apparatus may be more compact.

The slip apparatus may be configured such that a force required to be applied, e.g. by the slip actuator, for providing the second phase is higher than for the first phase.

Alternatively or additionally, the slip apparatus may comprise a second slip actuator. The operation of the second slip actuator may cause or provide the second phase of operation.

The secondary slip or slip arrangement may be mounted or mountable on the primary slip or slip arrangement. The primary slip or slip arrangement may carry the secondary slip or slip arrangement radially during the first phase of operation, e.g. while the first and second wall engaging surfaces are co-planar. The provision of the secondary slip or slip arrangement mounted on the primary slip or slip arrangement may establish a form of telescoping slip or slip arrangement, which may reduce space requirements of the slips or slip arrangements.

The slip apparatus may comprise the primary slip or slip arrangement displacement mechanism. The primary slip or slip arrangement displacement mechanism may move the primary slip or slip arrangement radially during the first phase of operation.

The primary slip or slip arrangement displacement mechanism may comprise a driving surface, such as a ramp, camming surface, or the like. In a preferred embodiment, the driving surface of the primary slip or slip arrangement displacement mechanism may be comprised in and/or defined by the slip actuator. The primary slip or slip arrangement displacement mechanism driving surface may cooperatively engage a surface defined by and/or comprised in the primary slip or slip arrangement. The primary slip or slip arrangement displacement mechanism and the surface defined by and/or comprised in the primary slip or slip arrangement may each comprise a stop member or shoulder, that may be arranged to engage each other at a given relative position of the primary slip or slip arrangement and the primary slip or slip arrangement displacement mechanism, which may define a range of travel of the primary slip or slip arrangement relative to the actuator.

The slip apparatus may comprise the secondary slip or slip arrangement displacement mechanism. The secondary slip or slip arrangement displacement mechanism may comprise a driving surface, such as a ramp, camming surface or the like. Advantageously, the driving surface of the secondary slip or slip arrangement displacement mechanism may be comprised in and/or defined by the primary slip or slip arrangement, e.g. in the first and/or second parts of the primary slip or slip arrangement. The secondary slip or slip arrangement may be movable radially outwardly by relative movement of the first and second parts of the primary slip or slip arrangement.

The secondary slip or slip arrangement displacement mechanism driving surface may cooperatively engage a surface defined by the secondary slip or slip arrangement.

The secondary slip or slip arrangement displacement mechanism and the surface defined by and/or comprised in the secondary slip or slip arrangement may each comprise a stop member or shoulder, that may be arrangeable to engage each other so as to define a range of travel of the secondary slip or slip arrangement relative to the primary slip or slip arrangement.

Advantageously, the secondary slip or slip arrangement displacement mechanism may move the secondary slip or slip arrangement radially during the second phase of operation only. Alternatively or additionally, the secondary slip or slip arrangement displacement mechanism may move the secondary slip or slip arrangement radially during the first and second phases of operation.

The primary slip or slip arrangement displacement mechanism may be actuated by the slip actuator. The secondary slip mechanism may be actuated by the slip actuator, e.g. via the primary slip or slip arrangement. Alternatively or additionally, the secondary slip or slip arrangement displacement mechanism may be actuated by the second slip actuator.

Although the primary and secondary slip displacement mechanisms are described above as comprising a driving surface, the primary and/or secondary slip displacement mechanisms may be or comprise other mechanisms, such as wedging or sloping surfaces, hydraulic or pneumatic pistons, mechanically actuated levers, rotating cams, and/or the like.

Advantageously, in use, the slip actuator may cause the driving surface of the primary slip or slip arrangement displacement mechanism to cooperatively engage a surface of the primary slip or slip arrangement and may push it radially.

At least part of the secondary slip or slip arrangement may be provided between the first and second parts of the primary slip or slip arrangement. Advantageously, particularly when the secondary slip or slip arrangement is mounted on the primary slip or slip arrangement, the secondary slip or slip arrangement may be simultaneously pushed radially with the primary slip or slip arrangement, at least during the first phase of operation.

Particularly in embodiments in which the secondary slip or slip arrangement is not mounted on the primary slip or slip arrangement, the slip actuator may act simultaneously directly onto the secondary slip or slip arrangement via the secondary displacement mechanism, e.g. to move it radially, optionally at the same pace as the primary slip or slip arrangement, during a first phase of operation and may radially move only the secondary slip or slip arrangement further during a second phase of operation.

However, the second actuator may act only on the secondary slip or slip arrangement displacement mechanism, e.g. to move the secondary slip or slip arrangement at the same pace as the primary slip or slip arrangement, which in turn may be actuated by the (first) slip actuator during a first phase of operation and may move the secondary slip or slip arrangement further during a second phase of operation.

Optionally, the (first) slip actuator may act simultaneously directly onto the secondary slip or slip arrangement, e.g. via the secondary slip or slip arrangement displacement mechanism, which may move the secondary slip or slip arrangement radially, e.g. at the same pace as the primary slip or slip arrangement, which may also be moved by the (first) slip actuator, during the first phase of operation and the second slip actuator may act on the secondary slip or slip arrangement displacement mechanism to radially move only the secondary slip or slip arrangement further during the second phase of operation.

Optionally the (first) slip actuator may cause the driving surface of the primary slip or slip arrangement displacement mechanism to move the primary slip or slip arrangement radially and may simultaneously radially move the secondary slip or slip arrangement mounted on the primary slip or slip arrangement during a first phase of operation and the second actuator may act on the secondary slip or slip arrangement displacement mechanism to further push or move only the secondary slip or slip arrangement radially during the second phase of operation.

It will be appreciated that the slip apparatus may move the primary and secondary slips or slip arrangements simultaneously during a first phase of operation, e.g. such that their wall engaging surfaces are flush, therefore acting as a conventional slip apparatus. However, the slip apparatus may also have the ability to subsequently operate in a second phase where only the secondary slip or slip arrangement is further moved radially. As described above, there may be several ways to achieve this effect, either by a single actuator or two actuators and also combining the possibility that the secondary slip or slip arrangement displacement mechanism is actuated directly or via the primary slip or slip arrangement.

The sequential movement of the primary and secondary slips or slip arrangements may be used to produce radially outwards or radially inward movements. When the movement is radially outwards, the apparatus may act as a slip apparatus for engaging inner surfaces of bores or other receptacles, such as borehole walls or tubular inner surfaces. When the movement is radially inwards, the apparatus may act as a tool for gripping receptacles such as tubulars at their outer surface. Both modes of operation may be used in oil and gas operations for providing grip or anchoring points and are deemed to fall within the scope of the invention.

In a preferred embodiment, the primary slip or slip arrangement displacement mechanism may comprise two driving surfaces, one at each end of the primary slip or slip arrangement.

Each driving surface may define a different angle with respect to the primary slip or slip arrangement wall engaging surface.

In a preferred embodiment, the secondary slip or slip arrangement displacement mechanism may comprise two driving surfaces, one at each end of the secondary slip or slip arrangement.

Each driving surface may define a different angle with respect to the secondary slip or slip arrangement wall engaging surface.

The primary slip or slip arrangement displacement mechanism may be configured to require less force to be applied to radially extend the primary slip or slip arrangement than the force applied to the secondary slip or slip arrangement displacement mechanism that would be required to radially extend the secondary slip or slip arrangement relative to the primary slip or slip arrangement. The driving surfaces of the primary slip or slip arrangement displacement mechanism may define smaller angles with respect to the primary slip or slip arrangement wall engaging surface than the angles defined by the driving surfaces of the secondary slip or slip arrangement displacement mechanism with respect to the secondary slip or slip arrangement wall engaging surface. This arrangement may allow a sequential first phase of operation and second phase of operation to be produced with a single actuator, which may be additional to, or may not require, a clutch arrangement.

The slip apparatus may comprise a plurality of radially extending or extendable slip assemblies. When a plurality of slip assemblies is provided, the anchoring forces applied to the slip apparatus may be less concentrated than when a single slip assembly is provided.

The plurality of radially extending slip assemblies may be positioned, e.g. evenly positioned, around a longitudinal axis of the slip apparatus. In this arrangement, the slip apparatus may also impart a centralizing function.

The plurality of radially extending slip assemblies may be positioned at the same longitudinal position along a longitudinal axis of the slip apparatus. This particular arrangement may reduce bending stresses along the slip apparatus.

At least one or more or each of the radially extending slip assemblies may be a unidirectional slip assembly. In this case, load applied in an operating direction may act to force the primary and/or secondary slip or slip arrangement further radially outwardly, which may serve to increase the gripping force applied by the downhole slip apparatus. The operating direction of at least one of the plurality of radially extending slip assemblies may be different, e.g. opposite, to the operating direction of at least one other of the plurality of radially extending slip assemblies. In this way, the plurality of radially extending slip assemblies may together be bidirectional.

An aspect or embodiment relates to an assembly comprising a pipe or tubular fitted with a downhole slip apparatus according to the above aspect.

An aspect of embodiment relates to a method of operating a downhole slip apparatus according to the above aspect, wherein the method comprises operating a slip actuator to: during a first phase of operation, radially extend the primary and secondary slips or slip arrangements simultaneously from a retracted configuration towards and/or into a first extended configuration, and during a subsequent second phase of operation, radially extend the secondary slip or slip arrangement relative to the primary slip or slip arrangement towards and/or into a second extended configuration.

It should be understood that the features defined above in accordance with any aspect or below in relation to any specific embodiment may be utilized, either alone or in combination with any other defined feature, in any other aspect or embodiment. Furthermore, the present disclosure is intended to cover apparatus configured to perform any feature described herein in relation to a method and/or a method of using, installing, producing, or manufacturing any apparatus feature described herein.

BRIEF DESCRIPTION OF THE DRAWINGS

These and other aspects of the invention will now be described, by way of example only, with reference to the accompanying drawings, in which.

DETAILED DESCRIPTION OF THE DRAWINGS

Embodiments of the present disclosure relate to a downhole slip apparatus 5. Such a slip apparatus 5 may be used to provide an anchor in an open or lined wellbore 10 to support any required downhole operation, system, or tool. For example, such a slip apparatus 5 may be used to secure tubing 15 and equipment within the wellbore 10, to establish a reaction point for other wellbore operations, such as setting packers, bridge plugs, frac plugs, or the like. Accordingly, while example embodiments of a slip apparatus 5 are described below, it should be understood that there is no limitation on the possible uses or applications of such slip apparatus 5.

Figure 1:
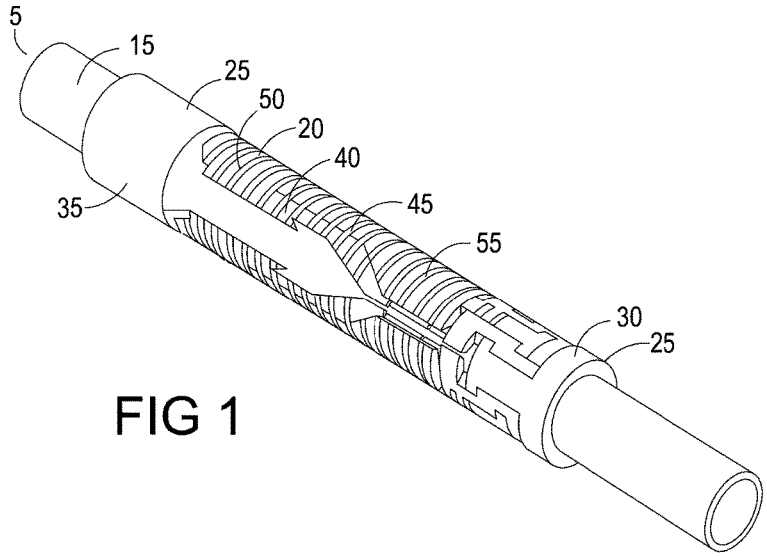
FIG. 1 is a perspective view of a downhole slip apparatus in accordance with an embodiment of the present disclosure, wherein the slip assembly is shown in a run-in, collapsed or unextended configuration.
Figure 2:
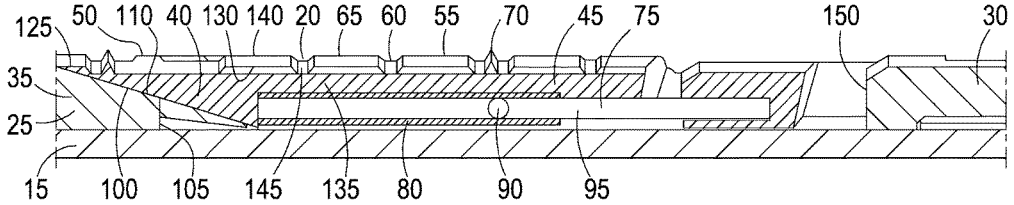
FIG. 2 is a sectional view taken through a portion of the slip apparatus of FIG. 1, particularly in the region of a clutch arrangement of the slip apparatus.
Figure 3:
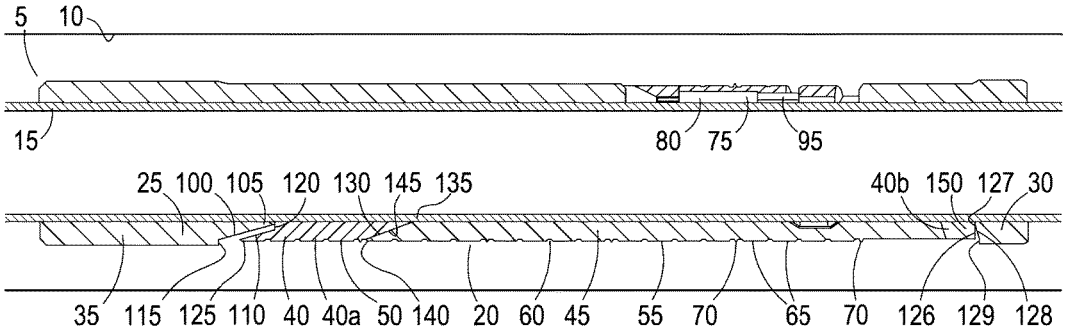
FIG. 3 is a cross-sectional view of the slip apparatus of FIG. 1, illustrated within a wellbore.

FIGS. 1 to 3 show a downhole slip apparatus 5 mounted on tubing 15 in a wellbore 10 in a run-in or un-extended configuration. The slip apparatus 5 comprises a slip assembly 20 and a slip actuator 25.

The slip actuator 25 comprises a fixed part 35, which is fixed to an outer surface of the tubing 15 in a conventional manner, and an operating part 30. The operating part 30 is slidably mounted on the tubing 15 such that it is movable towards the fixed part 35 in order to radially extend the slip assembly 20. The slip assembly 20 extends around the pipeline and is provided between the fixed part 35 and the operating part 30 of the slip actuator 25.

The slip assembly 20 comprises a primary slip arrangement 40 and a secondary slip arrangement 45. A radially outermost surface of the primary slip arrangement 40 forms a primary wall engaging surface 50. A radially outermost surface of the secondary slip arrangement forms a secondary wall engaging surface 55. The primary and secondary wall engagement surfaces 45, 50 both comprise grooves 60, plateaus 65, and pointed piercing projections 70 that extend radially further outward than the plateaus 65. This structure has been found to give particularly beneficial engagement and gripping properties for gripping an inner surface of a borehole 10. However, it will be appreciated that other gripping surface arrangements could be used.

The primary slip arrangement 40 comprises a first part 40*a* and a second part 40*b* that are selectively movable relative to each other. At least part of the second slip arrangement 45 is provided between the first part 40*a* and the second part 40*b* of the primary slip arrangement 40. The slip assembly 20 further comprises a clutch 75 coupled between the first and second parts 40*a*, 40*b* of the primary slip arrangement 40. The clutch 75 is configured to selectively lock the first and second parts 40*a*, 40*b* of the primary slip arrangement 40 together such that, when locked together, the first and second part 40*a*, 40*b* and thereby the primary slip arrangement 40 and the secondary slip arrangement 45 move together as a single unit. However, the clutch 75 is selectively releasable by applying a force to the clutch 75, whereupon the second part 40*b* can move relative to the first part 40*a*. Relative movement of the first part 40*a* and the second part 40*b* together moves the secondary slip arrangement 45 radially relative to the primary slip arrangement 40. In particular, the first 40 and second 45 slip arrangements are simultaneously and synchronously radially extendable as a single unit using the slip actuator 25 until a longitudinal force applied to the clutch 75 resulting from operation of the slip actuator 25 is greater than a threshold force, which releases the clutch 75. In this case, the clutch 75 is configured to allow relative movement of the first and second parts 40*a*, 40*b* of the primary slip arrangement 40 towards each other, whereupon the first and second parts 40*a*, 40*b* of the primary slip arrangement 40 cooperatively act on the secondary slip arrangement 45 to radially extend the secondary slip arrangement 45 relative to the primary slip arrangement 40, as shown in FIGS. 4 to 8.

As shown in FIGS. 2 and 3, the clutch arrangement 75 comprises a receiving member 80 in the form of an elongated hollow cylinder that is configured to receive an engagement part 90 (in this case a ball) and part of an elongate support 95 that supports the engagement part 90 at an end thereof. An end of the receiving member 80 opposite to that in which the engagement part 90 and support 95 are inserted is coupled to the first part 40*a* of the primary slip arrangement 40 and an end of the support 95 that is opposite to the end of the support 95 that supports the engagement part 90 is coupled to the second part 40*b* of the primary slip arrangement 40.

The outer diameter of the engagement part 90 is slightly greater than the inner diameter of the hollow cylinder receiving member 80 such that the engagement part 90 is interference fitted into the hollow cylinder receiving member 80. In particular, a slight deformation, which generally comprises both elastic and plastic deformations, occurs at the contact points between the engagement part 90 and the hollow cylinder receiving member 80 to provide the interference fit. The "give force" of the interference fit determines the threshold force required to operate the clutch 75. Since the deformation includes an elastic component, if the engagement member 90 is moved along the hollow cylinder receiving member 80, then the wall of the hollow cylinder receiving member 80 reverts at least partially back towards its pre-deformed state. In this way, the engagement part 90 is prevented from moving back in the opposite direction to the direction in which it is moved. It will be appreciated that the wall of the hollow cylinder receiving member 80 deforms part, but not all, of the way back towards its pre-deformation dimensions. As such, a subsequent clutch retaining force preventing the first and second parts 40*a*, 40*b* of the primary clutch 40 from moving back apart is less than the initial clutch retaining force.

In this way, the interference fit between the engagement part 90 and the hollow cylinder receiving member 80 selectively locks the first and second parts 40*a*, 40*b* of the primary slip arrangement 40. As such, the primary and secondary slip arrangements 40, 45 move together until a longitudinal force is applied that is greater than the threshold, which overcomes the interference fit and allows the engagement part 90 to move relative to the hollow cylinder receiving member 80 to thereby allow the first and second parts 40*a*, 40*b* of the primary slip arrangement 40 to move relative to each other. This in turn moves the secondary slip arrangement 45 relative to the primary slip arrangement 40, as detailed below.

A primary slip arrangement displacement mechanism 100 in the form of a reacting surface is provided at an end 105 of the fixed part 35 of the slip actuator 25 that is toward the primary slip arrangement 40. A primary cooperating surface 110 is provided on the primary slip arrangement 40. In this case, both the reacting surface 100 on the fixed part 35 of the slip actuator 25 and the primary cooperating surface 110 on the primary slip arrangement 40 comprise mutually sloping surfaces.

Specifically, the reacting surface 100 on the fixed part 35 of the slip actuator 25 comprises a sloping surface that slopes radially inwardly towards the end 105 of the fixed part 35 of the slip actuator 25, with a stop shoulder 115 being provided at the radially outermost part of the reacting surface 100. The primary cooperating surface 110 of the primary slip arrangement 40 slopes radially outwardly from a stop shoulder 120 at a radially innermost part thereof toward an end 125 of the primary slip arrangement 40 closest to the fixed part 35 of the slips actuator 25.

A further cooperating surface 126 slopes radially outwardly towards an end 127 of the primary slip arrangement 40 closest to the operating part 30. The operating part 30 comprises a corresponding sloping surface 128 that slopes radially inwardly towards an end of the operating part 30 that is closest to the slip arrangement 40 and has a stop 129 provided on a radially outward end thereof.

The primary cooperating surface 110 of the primary slip arrangement 40 is configured to cooperate with the reacting surface 100 on the fixed part 35 of the slip actuator 25 and the further cooperating surface 126 of the primary slip arrangement 40 is configured to cooperate with the corresponding surface 128 of the operating part 30. As a result, upon movement of the operating part 30 towards the fixed part 35, the operating part 30 pushes the primary slip arrangement 40 such that the primary cooperating surface 110 of the primary slip arrangement 40 rides up over the reacting surface 100 on the fixed part of the actuator 35 and the further cooperating surface 126 of the primary slip arrangement 40 rides up over the corresponding surface 128 of the operating part 30. Since the first part 40*a* of the primary slip arrangement is locked against movement relative to the second part 40*b* by the clutch 75, with the secondary slip arrangement 45 provided therebetween, the primary slip arrangement 40 and the secondary slip arrangement 45 are together forced radially outwardly in a combined motion. The stop shoulders 115, 120 and the stop 129 define the range of mutual motion/extension of the primary and secondary slip arrangements 40, 45.

The first part 40*a* of the primary slip arrangement 40 further comprises a secondary slip arrangement displacement mechanism 130 in the form of a driving surface that slopes radially inwardly towards an end 135 of the first part 40*a* of the primary slip arrangement 40 towards the secondary slip arrangement 45. An end 140 of the secondary slip arrangement 45 that is toward the first part 40*a* of the primary slip arrangement 40 is provided with a secondary cooperating surface 145 that slopes radially outwardly toward the end 140 so as to cooperate with the driving surface of the secondary slip arrangement displacement mechanism 130 provided on the primary slip arrangement 40. An opposite end 150 of the secondary slip arrangement 45 also comprises a cooperating sloping surface that cooperates with a complimentary sloping surface on the second part 40*b* of the primary slip arrangement 40.

In this way, in order to radially extend the slip assembly 20, the slip actuator 25 is operated by applying a longitudinal force to move the operating part 30 of the slips actuator 25 towards the fixed part 35. Since the slip assembly 20 is fitted between the fixed and operating parts 30, 35 of the slip actuator 25, the longitudinal force applied to the operating part 30 of the slip actuator 25 is transmitted through the primary and secondary slip arrangements 40, 45 and the clutch 75. This results in the reacting surface 100 on the fixed part 35 of the slips actuator 25 being forced into engagement with the primary cooperating surface 110 on the primary slip arrangement 40, resulting in the primary slip arrangement 40 camming off the driving surface 100 such that the primary slip arrangement 40 rides up over the driving surface 100, thereby being extended radially outwardly synchronously with the secondary slip arrangement 45, as described above.

Figure 4:
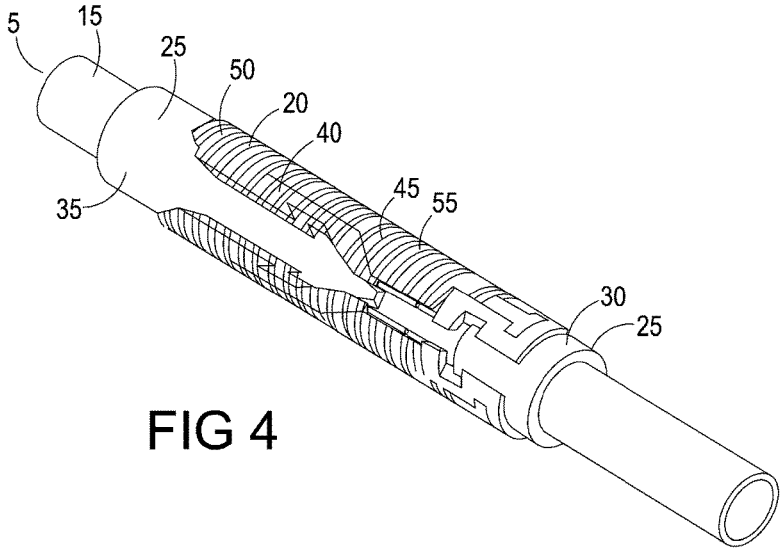
FIG. 4 is a perspective view of the downhole slip apparatus of FIG. 1, illustrated in a configuration following a first phase of operation.
Figure 5:
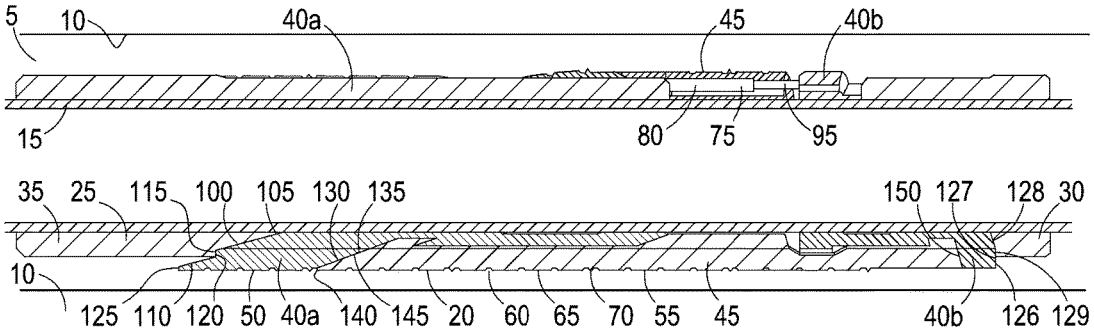
FIG. 5 is a cross sectional view of the slip apparatus in the configuration of FIG. 4, illustrated within a wellbore.

Since the primary slip arrangement 40 is moved radially outwardly, the force applied to the primary slip arrangement 40 by the operating part 30 is split between radial and axial (longitudinal) components, such that the axial (longitudinal) component is lower than the threshold force required to operate the clutch 75. As such, the clutch 75 maintains the secondary slip arrangement 45 in a configuration in which it moves simultaneously and synchronously radially outwardly with the primary slip arrangement 40, as shown in FIGS. 4 and 5.

This part of the operation of the slip apparatus 5 is comprised in a first phase in which the primary and secondary slip arrangements 40, 45 mutually move together. This phase continues until the primary cooperating surface 110 of the primary slip arrangement 40 has moved far enough up the driving surface 100 on the operating part 30 of the slip actuator 25 so that the stop shoulder 120 on the primary slip arrangement 40 engages with the corresponding stop shoulder 115 on the fixed part 35 of the slips actuator 25 and the stop 129 is engaged by a corresponding section of the further cooperating surface 126 of the primary slip arrangement 40. At this point, substantially the whole of the force applied to the operating part 30 of the slip actuator 25 is applied axially (longitudinally) to the primary slip arrangement 40 and clutch 75 rather than being split between radial and longitudinal components by the cooperating actions of the driving surface 100 and the primary cooperating surface 110 and of the further cooperating surface 126 and the corresponding sloping surface 128. This results in the longitudinal component of the applied force being greater than the threshold required to operate the clutch 75.

Once the longitudinal force being applied to the primary arrangement 40 and the clutch 75 due to operation of the slip actuator 25 becomes greater than the threshold, the interference grip of the engagement part 90 on the inside surface of the hollow cylinder receiving member 80 of the clutch 75 is overcome. This results in the clutch 75 releasing such that the engagement part 90 slides within the hollow cylinder receiving member 80. In this case, the first part 40*a* of the primary slip arrangement 40 moves relative to the second part 40*b* of the primary slip arrangement 40 to thereby move the secondary slip arrangement 45 relative to the primary slip arrangement 40.

Figure 6:
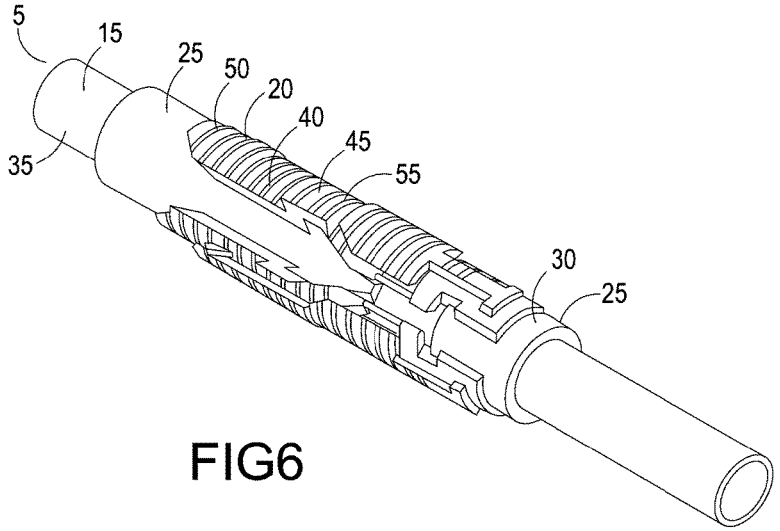
FIG. 6 is a perspective view of the slip apparatus of FIG. 1, illustrated in a configuration following a second phase of operation.
Figure 7:
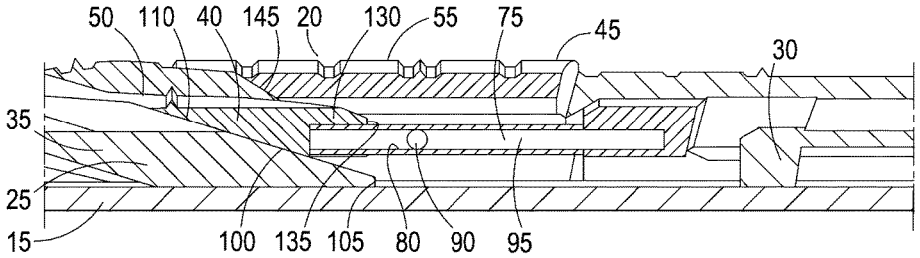
FIG. 7 is a sectional view taken through a portion of the slip apparatus of FIG. 6, particularly in the region of the clutch arrangement.
Figure 8:
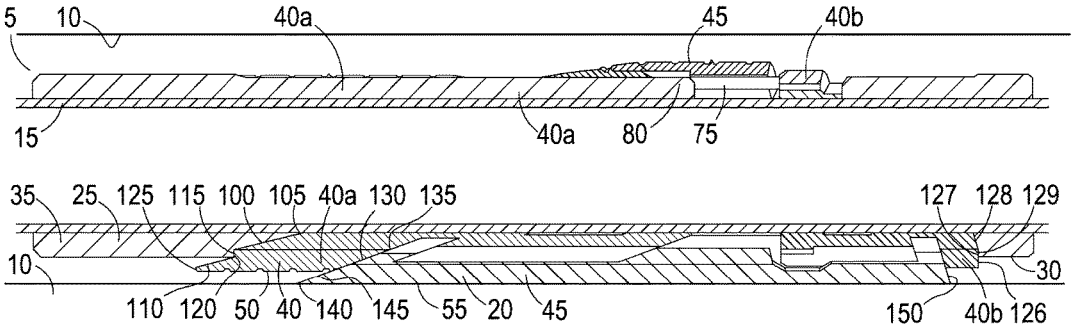
FIG. 8 is a cross sectional view of the slip apparatus in the configuration of FIG. 6, illustrated within a wellbore and engaging a bore wall.

This starts a second phase of operation in which the secondary slip arrangement 45 is movable radially outwardly relative to the primary slip arrangement 40, as shown in FIGS. 6 to 8. During this phase, the first and second parts 40*a*, 40*b* of the primary slip arrangements, which are moved relative to each other using the slip actuator 25, act on the secondary slip arrangement 45 such that the secondary cooperating surface 145 on the secondary slip arrangement 45 cams over the driving surface 130 on the primary slip arrangement 40, forcing the secondary slip arrangement 45 radially outwardly relative to the primary slip arrangement 40.

It will be appreciated that the clutch 75 is operable to provide a non-telescoping configuration of the primary and secondary slip arrangements 40, 45 when the longitudinal force applied to the clutch 75 is less than the threshold, and to allow the primary and secondary slip arrangements 40, 45 to telescope relative to each other when the longitudinal force applied to the clutch 75 is greater than the threshold.

In this way, the slip assembly 20 is extended during the first phase in which both the primary and secondary slip arrangements 40, 45 are simultaneously extended radially outwardly together, as shown in FIGS. 4 and 5. As such, for narrower boreholes, the slip assembly 20 can grip using the wall engaging surfaces 50, 55 of both the primary and secondary slip arrangements 40, 45. This can result in a greater gripping force than would be the case if the primary and secondary slip arrangements 40, 45 moved separately during the first phase. However, for larger diameter wellbore holes, the telescoping of the secondary and primary slip arrangements 40, 45 can be used to secure the slip apparatus 5, as shown in FIGS. 6 to 8.

Furthermore, the hollow cylinder receiving member 80 both elastically and plastically deforms slightly around the engagement part 90, such that when the engagement part 90 is moved, the previously deformed part of the hollow cylinder receiving member 80 restores at least partially back towards its previous configuration/position. As such, when the force is released from the slip actuator 25, the clutch 75 automatically reverts back to a state in which the secondary slip arrangement 45 is locked for movement relative to the primary slip arrangement 40. This may prevent a spring-back effect in which the secondary slip arrangement 45 relaxes radially inwardly when the force from the operating part 30 is released may be avoided, which in turn may prevent the slip apparatus 5 from slipping out of engagement with the wellbore 10.

Optionally, the slope of the driving surface 100 on the slip actuator and the primary cooperating surface 110 may be shallower than the slope of the driving surface 130 on the primary slip arrangement 40 and the secondary cooperating surface 145. This may result in a greater proportion of the force being transmitted radially rather than axially (longitudinally) during the first phase than during the second phase. In this way, a lesser force may be required to simultaneously jointly radially extend the primary and secondary slip arrangements 40, 45 relative to the force required to extend the secondary slip arrangement 45 relative to the primary slip arrangement 40. This may assist the operation of the clutch 75 or in certain cases may be used instead of the clutch 75.

A skilled person will appreciate that variations of the disclosed arrangements are possible without departing from the invention.

For example, although the first and second slip arrangements 40, 45 in the above embodiment move radially outwardly, it will be appreciated that the first and second slip arrangements could be configured to move radially inwardly.

Furthermore, although a specific slip actuator arrangement has been described above, it will be appreciated that other slip actuator arrangements could be used.

In addition, although cooperating sloping surfaces for moving the first and second slip arrangements relative to each other have been described above, it will be appreciated that other shapes or types of cooperating or cam surfaces or other moving arrangements such as actuators, pistons, magnetic or electromagnetic movement mechanisms and/or the like, could be used.

What is claimed is:

1. A downhole slip apparatus, comprising:

a radially extendable slip assembly comprising a primary slip defining a first wall engaging surface, a secondary slip defining a second wall engaging surface, and a selective coupling or clutch that is operable or configured such that:

during a first phase of operation the primary and secondary slips are radially extendable simultaneously from a retracted configuration towards and/or into a first extended configuration, and during a subsequent second phase of operation the secondary slip is radially extendable relative to the primary slip towards and/or into a second extended configuration, wherein the first and second wall engaging surfaces comprise piercing features and interference features.

2. The apparatus of claim 1, wherein, in the retracted configuration, the first and second engaging wall surfaces are flush, coplanar, aligned, and/or in register and remain flush, coplanar, aligned, and/or in register during or throughout the first phase of operation and/or in the first extended configuration.

3. The apparatus of claim 1, wherein during the second phase of operation and/or in the second extended configuration, the secondary slip extends beyond the primary slip.

4. The apparatus of claim 1, wherein the slip apparatus is configured such that, if the slip apparatus is in the first extended configuration and/or extended to its maximum extension, and the first and second wall engaging surfaces have not contacted the borehole wall, then the second phase of operation begins and only the secondary slip continues extending radially until the second wall engaging surface makes contact with the borehole wall.

5. The apparatus of claim 1, wherein the selective coupling or clutch is operable or switchable according to an operating parameter.

6. The apparatus of claim 5, wherein the operating parameter is or comprises a force applied to the selective coupling or clutch using a slip actuator.

7. The apparatus of claim 5, wherein the selective coupling or clutch is configured to require a greater force for the second phase of operation than for the first phase of operation and the selective coupling or clutch is configured to selectively couple, fix, or otherwise hold the primary and secondary slips together when the operating parameter is in a first range or lower than a threshold and configured to permit the primary and secondary slips to be radially extended or extendable relative to each other when the operating parameter is in a second range or greater than the threshold.

8. The apparatus of claim 1, wherein the selective coupling or clutch comprises an interference fit mechanism.

9. The apparatus of claim 8, wherein the interference fit mechanism comprises a hollow receiving member defining an elongated cavity and an interfering member that comprises an engaging part that engages an inner wall of the cavity.

10. The apparatus of claim 8, wherein the selective coupling or clutch is configured such that local elastic deformations are present at the contact area between the engaging part and the inner wall of the cavity, the selective coupling or clutch being configured such that, as the engaging part moves, the cavity wall at the back of the engaging part deforms at least partially back towards its previous or undeformed position.

11. The apparatus of claim 1, wherein the downhole slip apparatus comprises or is configured to receive a slip actuator, wherein, in use, the slip assembly is radially extended or extendable towards the bore or other receptacle by operation of the slip actuator.

12. The apparatus of claim 1, wherein the secondary slip is mounted on the primary slip.

13. The apparatus of claim 11, wherein the slip actuator comprises a primary slip displacement mechanism that moves the primary and secondary slips radially during the first phase of operation.

14. The apparatus of claim 13, wherein the slip apparatus comprises a secondary slip displacement mechanism that moves the secondary slip radially during the second phase of operation only.

15. The apparatus of claim 13, wherein the primary slip displacement mechanism comprises a driving surface, comprised in and/or defined by the slip actuator, wherein the driving surface cooperatively engages a surface defined by and/or comprised in the primary slip to push the primary slip radially.

16. The apparatus of claim 14, wherein the secondary slip displacement mechanism comprises a driving surface that is comprised in and/or defined by the primary slip or the slip actuator, wherein the driving surface of the secondary slip displacement mechanism is configured to cooperatively engage a surface defined by the secondary slip to push the secondary slip radially.

17. The apparatus of claim 16, wherein the driving surfaces of the primary slip displacement mechanism define smaller angles with respect to the first wall engaging surface than the angles defined by the driving surfaces of the secondary slip displacement mechanism with respect to the second wall engaging surface.

18. An assembly comprising a pipe or tubular fitted with a downhole slip apparatus according to claim 1.

19. A method of operating a downhole slip apparatus, the downhole slip apparatus comprising a radially extendable slip assembly comprising a primary slip defining a first wall engaging surface, a secondary slip defining a second wall engaging surface, and a selective coupling or clutch, the clutch or selective coupling being configured or operable such that during a first phase of operation the primary and secondary slips are radially extendable simultaneously from a retracted configuration towards and/or into a first extended configuration, and during a subsequent second phase of operation the secondary slip is radially extendable relative to the primary slip towards and/or into a second extended configuration, wherein the first and second wall engaging surfaces comprise piercing features and interference features, wherein the downhole slip apparatus comprises or is configured to receive a slip actuator, wherein the method comprises:

operating the slip actuator such that, during the first phase of operation, the primary and secondary slips are radially extended simultaneously from the retracted configuration towards and/or into the first extended configuration;

operating or reconfiguring the clutch or selective coupling; and operating the slip actuator such that, during the subsequent second phase of operation, the secondary slip radially extends relative to the primary slip towards and/or into the second extended configuration.

20. The method of claim 19, wherein, in the retracted configuration, the first and second engaging wall surfaces are flush, coplanar, aligned and/or in register and remain flush, coplanar, aligned and/or in register during or throughout the first phase of operation and/or in the first extended configuration and during the second phase of operation and/or in the second extended configuration, the secondary slip extends beyond the primary slip.

21. The method of claim 19, wherein the slip apparatus is configured such that, if the slip apparatus is in the first extended configuration and/or extended to its maximum extension, and the first and second wall engaging surfaces have not contacted the borehole wall, then the second phase of operation begins and only the secondary slip continues extending radially until the second wall engaging surface makes contact with the borehole wall.

22. The method of claim 19, wherein the selective coupling or clutch is operable or switchable according to an operating parameter.

23. The method of claim 22, wherein the operating parameter is or comprises a force applied to the selective coupling or clutch; and wherein the method comprises using the slip actuator to apply a force to operate or switch the selective coupling or clutch.

* * * * *